US011008860B2

(12) United States Patent
He et al.

(10) Patent No.: US 11,008,860 B2
(45) Date of Patent: May 18, 2021

(54) EQUIPMENT SYSTEM FOR NO-ROADWAY NO-COAL-PILLAR RETAINED ROADWAY MINING METHOD

(71) Applicant: Manchao He, Beijing (CN)

(72) Inventors: Manchao He, Beijing (CN); Jun Yang, Beijing (CN); Shangyuan Chen, Beijing (CN); Haijiang Zhang, Beijing (CN)

(73) Assignee: Manchao He, Beijing (CN)

( * ) Notice: Subject to any disclaimer, the term of this patent is extended or adjusted under 35 U.S.C. 154(b) by 0 days.

(21) Appl. No.: 15/739,474

(22) PCT Filed: Jun. 24, 2016

(86) PCT No.: PCT/CN2016/086983
§ 371 (c)(1),
(2) Date: Mar. 27, 2018

(87) PCT Pub. No.: WO2016/206616
PCT Pub. Date: Dec. 29, 2016

(65) Prior Publication Data

US 2018/0187548 A1 Jul. 5, 2018

(30) Foreign Application Priority Data

Jun. 24, 2015 (CN) ..... 201510354564.X
Sep. 30, 2015 (CN) ..... 201510642211.X
Jun. 16, 2016 (CN) ..... 201610430421.7

(51) Int. Cl.
*E21D 23/00* (2006.01)
*E21C 41/18* (2006.01)
(Continued)

(52) U.S. Cl.
CPC ..... *E21C 41/18* (2013.01); *E21C 41/16* (2013.01); *E21D 15/00* (2013.01); *E21D 15/02* (2013.01);
(Continued)

(58) Field of Classification Search
CPC . E21D 23/0004; E21D 23/0034; E21D 23/03; E21C 41/18
See application file for complete search history.

(56) References Cited

U.S. PATENT DOCUMENTS 3,949,563 A 4/1976 Wertelewski et al.
4,010,618 A 3/1977 Walker et al.
(Continued)

FOREIGN PATENT DOCUMENTS

CN 1936271 A 3/2007
CN 200999613 Y 1/2008
(Continued)

OTHER PUBLICATIONS

International Search Report issued in the counterpart PCT application No. PCT/CN2016/086983, dated Sep. 27, 2016, by the SIPO as ISA.
(Continued)

*Primary Examiner* — Janine M Kreck
(74) *Attorney, Agent, or Firm* — Qinghong Xu

(57) ABSTRACT

An equipment system for a self-retaining mining method mainly comprises a transition support, an end support, a following support, and a fast-retracting support. Working face gateroads do not need to advance in mining, and a coal mining machine may be used to cut a neat coal wall at the end of a district. The entry rib is automatically formed after roof caving, thus forming a gateroad in a re-mining process. The coal mining machine is under digital control when its end cuts the coal, automatically enabling the end to laterally
(Continued)

cut the coal wall to form a vertical straight line, which is used as the entry rib of the gateroad. A scrapper conveyor works in coordination with an arc-shaped coal grabbing plate of the coal mining machine to clean up float coal at the end as much as possible.

10 Claims, 5 Drawing Sheets

(51) Int. Cl.
*E21C 41/16* (2006.01)
*E21D 15/00* (2006.01)
*E21D 23/04* (2006.01)
*E21D 15/02* (2006.01)

(52) U.S. Cl.
CPC ..... *E21D 23/0047* (2013.01); *E21D 23/0481* (2013.01)

(56) References Cited

U.S. PATENT DOCUMENTS

| | | | | |
|---|---|---|---|---|
| 4,067,618 | A | 1/1978 | Nakajima et al. | |
| 4,094,153 | A * | 6/1978 | Blumenthal | E21D 23/0454 405/296 |
| 4,189,257 | A | 2/1980 | Nakajima et al. | |
| 4,339,216 | A * | 7/1982 | Bell | E21D 19/02 299/33 |
| 4,378,132 | A | 3/1983 | Spies et al. | |
| 5,385,433 | A * | 1/1995 | Calandra, Jr. | E21D 11/006 405/259.1 |
| 2005/0067879 | A1* | 3/2005 | Burgess | E21C 27/02 299/95 |
| 2011/0006586 | A1* | 1/2011 | Holme | E21D 23/0017 299/33 |

FOREIGN PATENT DOCUMENTS

| | | | |
|---|---|---|---|
| CN | 101289939 | A | 10/2008 |
| CN | 201180544 | Y | 1/2009 |
| CN | 101457652 | A | 6/2009 |
| CN | 101649741 | | 2/2010 |
| CN | 201486582 | U | 5/2010 |
| CN | 101725368 | A | 6/2010 |
| CN | 101775991 | A | 7/2010 |
| CN | 101906979 | A | 12/2010 |
| CN | 102071958 | A | 5/2011 |
| CN | 102080557 | A | 6/2011 |
| CN | 102116155 | A | 7/2011 |
| CN | 102155219 | A | 8/2011 |
| CN | 102182460 | A | 9/2011 |
| CN | 102287211 | A | 12/2011 |
| CN | 102287212 | A | 12/2011 |
| CN | 102337904 | A | 2/2012 |
| CN | 102383814 | A | 3/2012 |
| CN | 102392642 | A | 3/2012 |
| CN | 102536239 | A | 7/2012 |
| CN | 102606207 | A | 7/2012 |
| CN | 102704935 | A | 10/2012 |
| CN | 102877872 | A | 1/2013 |
| CN | 102926781 | A | 2/2013 |
| CN | 102943683 | A | 2/2013 |
| CN | 102966354 | A | 3/2013 |
| CN | 102996131 | A | 3/2013 |
| CN | 102996150 | A | 3/2013 |
| CN | 103195426 | | 7/2013 |
| CN | 103195426 | A | 7/2013 |
| CN | 103266893 | | 8/2013 |
| CN | 103459772 | A | 12/2013 |
| CN | 103775085 | A | 5/2014 |
| CN | 103775117 | A | 5/2014 |
| CN | 103867224 | A | 6/2014 |
| CN | 103953377 | A | 7/2014 |
| CN | 203717006 | U | 7/2014 |
| CN | 203717008 | U | 7/2014 |
| CN | 104005779 | A | 8/2014 |
| CN | 104033151 | A | 9/2014 |
| CN | 104179520 | A | 12/2014 |
| CN | 204060781 | U | 12/2014 |
| CN | 104358572 | A | 2/2015 |
| CN | 204646284 | CN | 9/2015 |
| CN | 105240013 | A | 1/2016 |
| CN | 105275487 | A | 1/2016 |
| DE | 2344490 | A1 | 3/1975 |
| DE | 2731101 | A1 | 1/1979 |
| DE | 2344490 | C3 | 3/1983 |
| DE | 3618437 | A1 | 12/1987 |
| DE | 10300387 | A1 | 7/2004 |
| DE | 202005007257 | U1 | 7/2005 |
| DE | 102008050068 | B3 | 1/2010 |
| GB | 1381544 | A | 1/1975 |
| GB | 1416488 | A | 12/1975 |
| GB | 8819961 | | 9/1988 |
| RU | 2058487 | C1 | 4/1996 |
| RU | 2178526 | C1 | 1/2002 |
| RU | 2272136 | C1 | 3/2006 |
| RU | 2287060 | C1 | 11/2006 |
| RU | 2532929 | C1 | 11/2014 |
| SU | 184227 | A1 | 8/1966 |
| SU | 623970 | A1 | 9/1978 |
| SU | 775330 | A1 | 10/1980 |
| SU | 1023102 | A | 6/1983 |
| SU | 1263868 | A1 | 10/1986 |
| UA | 28923 | U | 12/2007 |
| WO | 2013102309 | A1 | 7/2013 |

OTHER PUBLICATIONS

The 1st office action issued in the counterpart CN application No. 201610430421.7 dated Aug. 8, 2017, by the SIPO.
The CN1OA No. 2017114831610 issued by CNIPA dated Nov. 26, 2018.
The CN1OA No. 2017114797446 issued by CNIPA dated Dec. 3, 2018.
Tu, Shi-Hao et al, "The Key Technique on Layout of Entry Entirely in Thick Coal Seam", Journal of China University of Mining & Technology, Mar. 2004, vol. 33, No. 2.
The CN1OA No. 2017114796265 issued by CNIPA dated Dec. 14, 2018.
The CN1OA No. 201610425964X issued by CNIPA dated Aug. 25, 2017.
The CN1OA No. 2015107077070 issued by CNIPA dated Feb. 22, 2017.
The CN10A No. 2016104259762 issued by CNIPA dated Aug. 7, 2017.
The CN1OA No. 2016104291753 issued by CNIPA dated Aug. 18, 2017.
The CN1OA No. 2016104298470 issued by CNIPA dated Aug. 17, 2017.
The CN1OA No. 2016104303341 issued by CNIPA dated Aug. 7, 2017.
The CN1OA No. 2017114634896 issued by CNIPA dated Nov. 2, 2018.
The ISR No. PCT/CN2016086985 issued by WIPO dated Sep. 27, 2016.
"Technologies of gob-side entry retaining with no-pillar in condition of overlying and thick-hard roof".
The CN3OA dated Apr. 28, 2019 by the CNIPA.
The Search Report from application No. 201610429175.3.
The Search Report from application No. 201610429847.0.
The Search Report from application No. 201610430334.1.
The Search Report from application No. 201610430421.7.
The UANOA issued Feb. 3, 2020 by the UA Office.
Range of Applicability of Basic Schemes.
The UA1OA issued Dec. 3, 2019 by the UA Office.

* cited by examiner

EQUIPMENT SYSTEM FOR NO-ROADWAY NO-COAL-PILLAR RETAINED ROADWAY MINING METHOD

CROSS-REFERENCE TO RELATED APPLICATIONS

The present application is based on International Application No. PCT/CN2016/086983, filed on Jun. 24, 2016, which is based upon and claims priority to Chinese Patent Application No. 201610430421.7, filed on Jun. 16, 2016, Chinese Patent Application No. 201510642211.X, filed on Sep. 30, 2015, and Chinese Patent Application No. 201510354564.X, filed on Jun. 24, 2015, and the entire contents thereof are incorporated herein by reference.

TECHNICAL FIELD

This present disclosure relates to an equipment for a coal mine working face, in particular, to an equipment system for a no-entry non-pillar entry self-retaining mining method, which provides a safeguard for implementing a no-entry excavation non-pillar mining method.

BACKGROUND

At present, in the process of longwall mining, a 121 mining method as shown in FIG. 1 is generally used, that is, firstly, two entries are excavated in the working face and one coal pillar is reserved for supporting. Specifically, each working face 10 includes an upper gateroad 11, a lower gateroad 12 and a mining face 13. The upper gateroad 11 of the individual working face 10 is connected to a haulage dip 14, and the lower gateroad 12 of the individual working face 10 is connected to an air-return dip 15, in addition, a track dip 16 is also provided. In such structure, the coal pillar needs to be reserved, which causes significant waste of resources. Moreover, it is required to excavate two entries for each working face, and thereby the work efficiency is low.

With development of a large-scale coal mining, amount of coal resources will be reduced day by day, especially in current downturn of the coal industry, the problems, such as high mining cost and low recovery rate of the coal, caused by reserving the coal pillar and excavating entries along the gob area, increasingly arise.

The Background portion contains the contents which are merely used for reinforcing understanding of the background technology of the present disclosure, and thus may include information that does not constitute the prior art as already known by an ordinary person skilled in the art.

SUMMARY

An object of the present disclosure is to overcome shortcomings of the existing technology. Thereby, an equipment system for a no-entry non-pillar entry self-retaining mining method is provided.

An another object of the present disclosure is to design an equipment system for a no-entry non-pillar entry self-retaining mining method, to meet various technical needs for a no-entry excavation non-pillar mining method, such that the object of no-entry excavation and non-pillar mining in the district can be achieved.

Additional aspects and advantages of the disclosure will in part set forth in the description below, and in part will become obvious from the description, or may be learned from practice of the present disclosure.

In one aspect of the present disclosure, an equipment system for no-entry non-pillar entry self-retaining mining method is provided. The equipment system mainly includes a transition support, an end support, a following support, a retracting support, a cutting device and a coal mining system; the coal mining system performs coal mining work in a mining passage that has an outer end connected to an upper gateroad and an inner end connected to a lower gateroad; the lower gateroad is an entry retaining area, the upper gateroad and the lower gateroad are substantially parallel to a mining direction of the coal mining system, and an area between the rear side of the mining passage and the outer side of the entry retaining area is a pressure release area at a gob; the transition support, the end support, the following support and the retracting support telescopically support a bottom rock mass and a top rock mass of the district; the transition support is positioned between the mining passage, the pressure release area at the gob and the entry retaining area; the end support is positioned within an overlapped area between the mining passage and the entry retaining area; there are multiple sets of the following supports with at least two in each set, and the following supports are positioned in and arranged in turn along the entry retaining area; the retracting support supports the mining passage; and as the coal mining system is advanced forward for mining, the mining passage is advanced forward, and the transition support, the end support, the following support and the retracting support move forward along with the mining passage; a longitudinal cutting operation is performed on the top rock mass along a boundary line between the entry retaining area and the pressure release area at the gob by using the cutting device, and thereby the top rock mass collapses to form the pressure release area at the gob.

According to one embodiment of the present disclosure, the cutting device includes at least one cutting drilling machine by which a plurality of drilling holes are formed on the top rock mass at a certain distance, and the plurality of drilling holes are expanded to be linear slits by a blasting or expanding device.

According to one embodiment of the present disclosure, a plurality of common supports are further arranged in the mining passage and telescopically support the bottom rock mass and the top rock mass.

According to one embodiment of the present disclosure, the equipment system further has a net overlaying device, and a protection net is laid in the front of the transition support and the end support along the bottom of the top rock mass, and the protection net is arranged between the transition support, the end support and the top surface of the following support and the bottom surface of the top rock mass.

According to one embodiment of the present disclosure, the coal mining system includes a coal mining machine and a scraper conveyor, and the scraper conveyor is positioned on the bottom of the mining passage, and the coal mining machine is movably mounted on the scraper conveyor.

According to one embodiment of the present disclosure, a plurality of gangue prevention plates are mounted between the entry retaining area and the pressure release area at the gob, and are laid on an outside rib of the entry retaining area; the gangue prevention plate is provided with a plurality of reserved holes through which anchor rods or anchor lines are mounted onto the gob pressure-relied area.

According to one embodiment of the present disclosure, the following support is provided with a lateral support telescopic rod that supports the gangue prevention plate.

According to one embodiment of the present disclosure, the equipment system further includes a plurality of anchor hole drilling machines, by means of which the anchor lines or the anchor rods are mounted on the top or the rib of the entry retaining area.

According to one embodiment of the present disclosure, the transition support is provided with the cutting device, and working slots are reserved on the top beam of the transition support.

According to one embodiment of the present disclosure, at least one anchor line drilling machine is mounted on the end support, and working holes and/or slots are reserved on the top beam of the end support.

BRIEF DESCRIPTION OF THE DRAWINGS

The various objects, features and advantages of the present disclosure will be apparent from the following detailed description of the preferable embodiments taken in conjunction with the accompanying drawings. The figures are only illustrative for the present disclosure, but not necessarily to scale. In the drawings, the same reference numbers will be used throughout the drawings to refer to the same or like parts. In the drawings.

DESCRIPTION OF THE REFERENCE NUMBERS IS PRESENTED BELOW

2. district; 20. first mining face; 21. upper gateroad; 22. lower gateroad; 25. air-return dip; 26. track dip; 27. mining passage; 28. haulage dip; 29. pressure release area at the gob; 3. transition support; 4. end support; 5. following support; 51. top-cutting following support; 52. gangue prevention following support; 6. retracting support; 7. coal mining system; 71. coal mining machine; 72. scraper conveyor.

10. working face; 11. upper gateroad; 12. lower gateroad; 13. mining face; 14. haulage dip; 15. air-return dip; 16. track dip.

DETAILED DESCRIPTION

Now, the exemplary embodiments will be described more fully with reference to the accompany drawings. However, the exemplary embodiments can be implemented in various forms and should not be construed as limited to the embodiments set forth herein. Instead, these embodiments are provided so that this disclosure will be thorough and complete, and the concept of the exemplary embodiment will fully convey to those skilled in the art. Same reference signs denote the same or similar structures in the accompany drawings, and thus the detailed description thereof will be omitted.

One embodiment of the present disclosure involves a no-entry non-pillar entry self-retaining mining method. The mining method is a novel coal mining method with regard to a single working face, it is not necessary to excavate upper gateroads and lower gateroads prior to mining on the working face, no need to reserve coal pillars during mining, and ventilation of the entire district can be ensured. The term "district" as used herein refers to a mining block section that has an independent production system and is divided along a strike within a phase or a mining level. A nearly horizontal coal seam can be also referred as a panel. An inclined longwall strip mining district can also be referred as a strip district. Hereinafter, the structure of a specific embodiment will be illustrated in detail.

Figure 1:
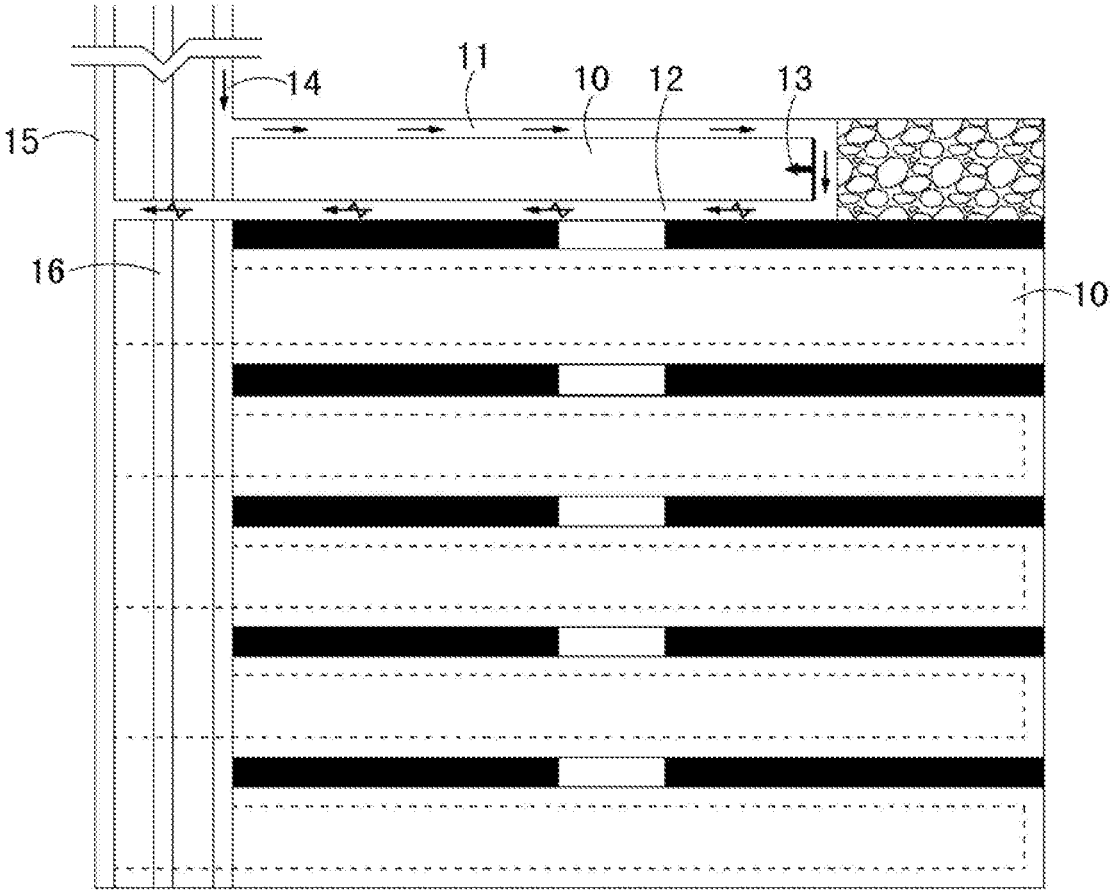
Fig.1 (Prior Art)
FIG. 1 is a schematic plan view of coal mining work by using a 121 mining method in the prior art.
Figure 2:
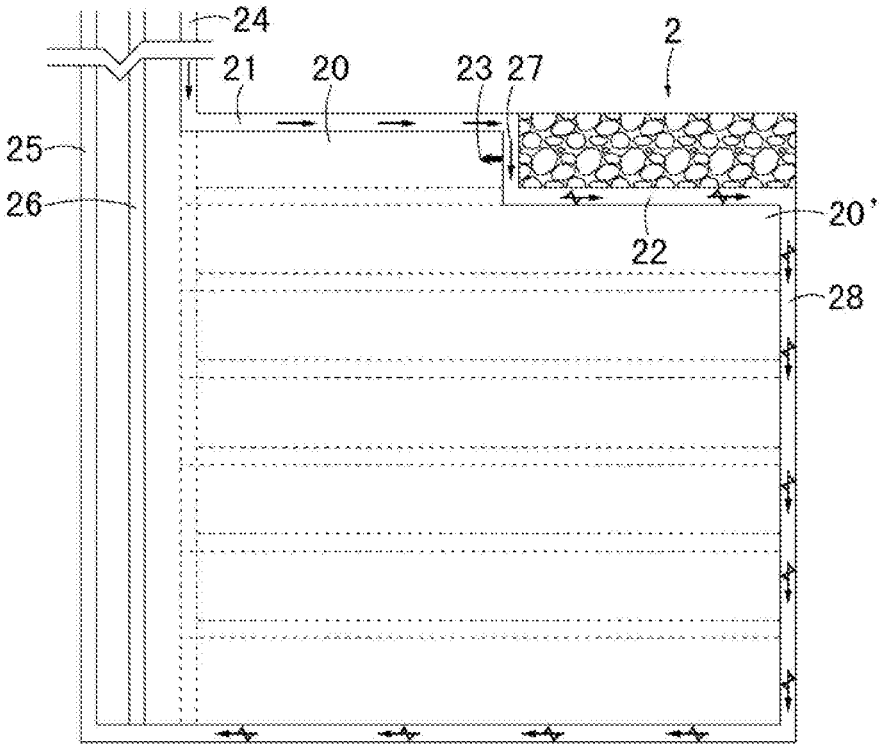
FIG. 2 is a schematic plan view of a no-entry non-pillar entry self-retaining mining method according to an embodiment of the present disclosure.
Figure 3:
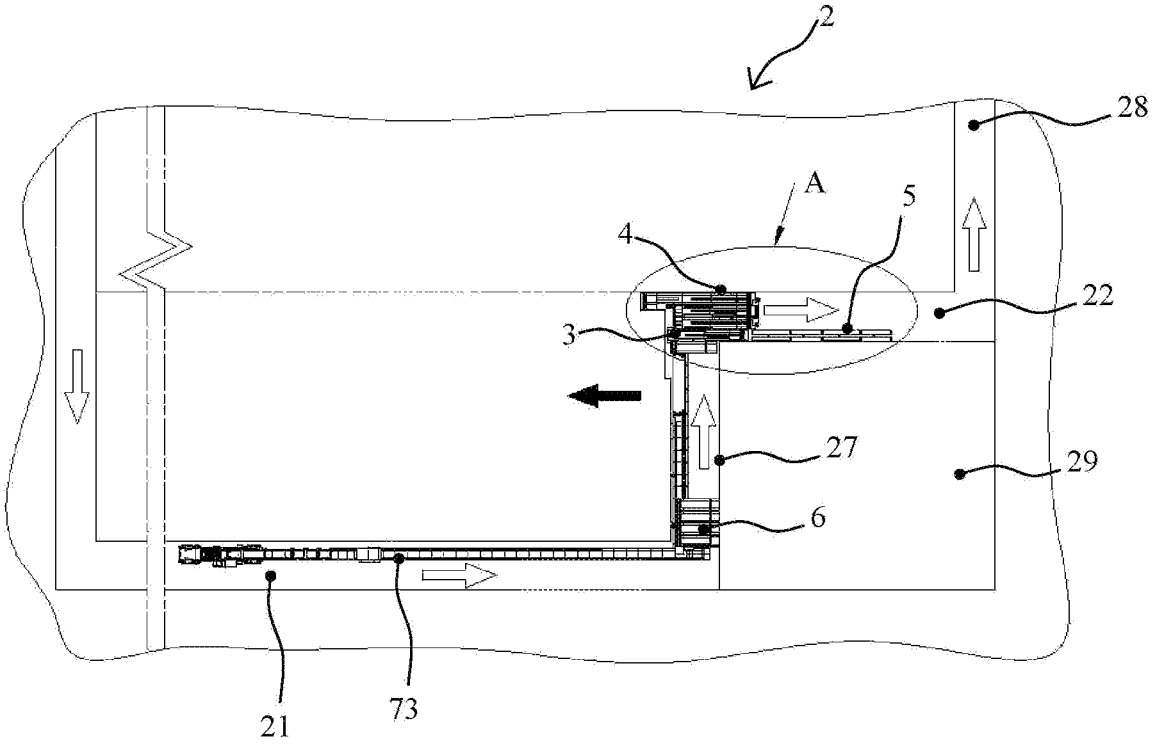
FIG. 3 is a schematic top view showing the overall arrangement of an equipment system for the no-entry non-pillar entry self-retaining mining method according to the embodiment of the present disclosure.
Figure 4:
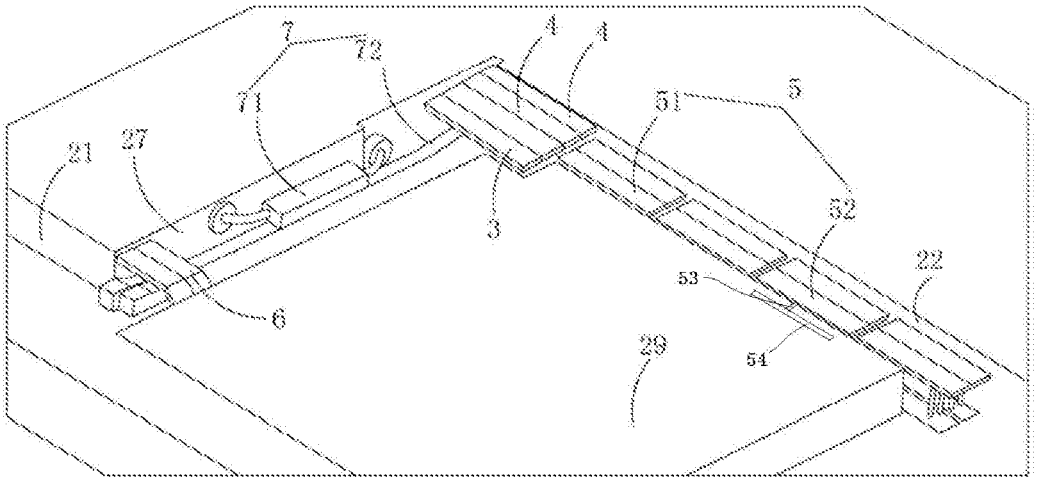
FIG. 4 is a schematic perspective view showing the overall arrangement of the equipment system for the no-entry non-pillar entry self-retaining mining method according to the embodiment of the present disclosure.
Figure 5:
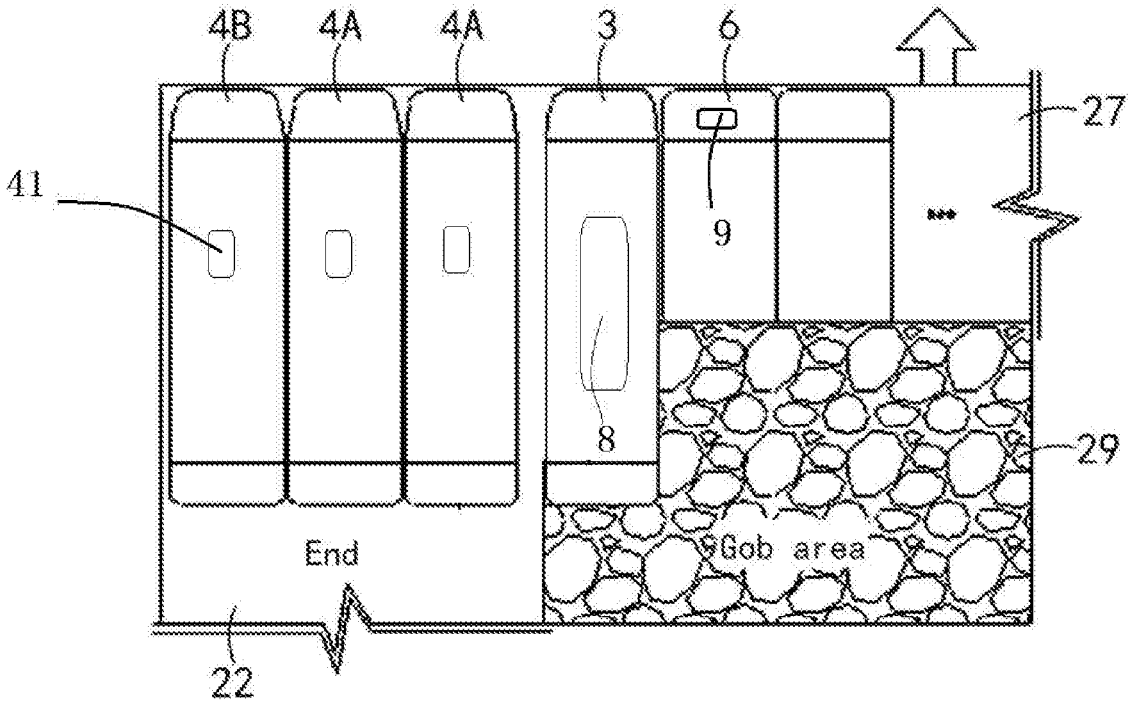
FIG. 5 is a schematic view showing the arrangement of a mining passage and the supports in the entry retaining area according to the embodiment of the present disclosure.

FIG. 2 is a schematic plan view of a no-entry excavation non-pillar mining method according to an embodiment of the present disclosure. FIG. 3 is a schematic top view of an integrate arrangement of an equipment system for the no-entry non-pillar entry self-retaining mining method according to the embodiment of the present disclosure. FIG. 4 is a schematic perspective view of the integrate arrangement of the equipment system for the no-entry non-pillar entry self-retaining mining method according to the embodiment of the present disclosure. FIG. 5 is a schematic view of an arrangement of the mining passage and supports of the entry retaining area according to the embodiment of the present disclosure.

The no-entry non-pillar entry self-retaining mining method according to the embodiment of the present disclosure, as shown in FIG. 2 in one specific embodiment, includes at least one district 2 having an air-return dip 25 and a track dip 26 are directly arranged at one side where, and a haulage dip 28 communicated with the shaft head of the district and the other side. The air-return dip 25, the track dip 26 and the haulage dip 28 are communicated with the shaft head, and the haulage dip 28 encloses the entire district 2 and then communicates with the air-return dip 25 to form an integrate ventilation system of the district 2. The district mentioned herein refers to a mining block section that has an independent production system and is divided along a strike within a phase or a mining level. In the embodiment, the district 2 can be divided into a plurality of working faces according to working requirements. For example, on a first mining face 20, one section of the haulage dip 28 serves as the upper gateroad 21 of the first mining face 20 to perform ventilation and convey the coal out.

The embodiment of the present disclosure illustratively provides an equipment system suitable for the no-entry non-pillar entry self-retaining mining method, to achieve an object of no-entry excavation non-pillar mining of the district.

The equipment system for the no-entry non-pillar entry self-retaining mining method according to the embodiment of the present disclosure, a general layout view of the equipment system fitting to the working face is selectively shown in FIG. 3 and FIG. 4, and arrangement orientation of the equipment herein is a mirror orientation in FIG. 2, thereby indicating implementation of the equipment system does not depend on the specific orientation relation.

It can be selected to perform no-entry non-pillar self-reserved entry mining work in the district by means of the equipment system. The equipment system can mainly include a transition support 3, an end support 4, a following support 5, a retracting support 6, a cutting device and a coal mining system 7. The coal mining system performs coal mining work in the mining passage 27. The coal mining machine advances mining in an extending direction of the upper gateroad 21 (i.e., in a direction as indicated by a solid arrow in the figure). The mining passage 27 has an outer end communicated with the upper gateroad 21 and an inner end communicated with the lower gateroad 22. The lower gateroad 22 herein may be formed by continuously retaining entry during mining, wherein the upper gateroad 21 and the lower gateroad 22 are substantially parallel to a mining direction of the coal mining system 7, an area between the rear side of the mining passage 27 and the outside of the lower gateroad 22 (also referred to as the entry retaining area) may be a pressure release area at a gob 29, which is a rear gob area created by continuous operation of the coal mining system.

A mining direction of the coal mining system 7 as described in the description refers to overall advancing direction, in a direction as indicated by the solid arrow in FIG. 3, the coal mining machine in the coal mining system 7 may perform mining towards the left or the right along a front wall in the mining passage 27, in order to propel to the advancing direction. The upper gateroad 21 and the lower gateroad 22 are substantially parallel to the mining direction of the coal mining system 7, wherein the "substantially parallel" means an unavoidable deviation during mining, and sometimes can be adjusted according to the special situations of coal seams and geology, but being substantially in a parallel state. The gateroads are formed by continuously retaining entry during the mining work.

Wherein, referring to FIG. 5, the transition support 3, the end support 4, the following support 5 and the retracting support 6 all telescopically support the bottom rock mass and the top rock mass of the district. The implementations of these supports may be described that each support has both a top plate and a bottom plate, while hinged legs and/or hydraulic cylinder legs are movably supported between the top plate and the bottom plate.

According to one embodiment of the present disclosure, the transition support 3 may be positioned between the mining passage 27, the pressure release area at the gob 29 and the lower gateroad 22. As an example, a length direction of the transition support 3 may be selected to be approximately perpendicular to the mining passage 27, the rear portion of the transition support 3 may be positioned in the pressure release area at the gob 29, the front portion of the transition support 3 may be positioned in the mining passage 27, a side of the transition support 3 closely attach to the edge of the lower gateroad 22 (i.e., entry retaining area), thereby, a free room is retained in the front portion of the transition support 3, in order to reserve a space through which the coal mining machine performs operations. Such arrangement of the transition support 3 can support the mining passage 27 and the lower gateroad 22 simultaneously, reduce ventilation quantity, such that the overall ventilation of the entry cannot be affected by wall-like equipment, reserve sufficient space through which the coal mining machine can pass, and thereby cannot affect mining work, and also facilitate for overlaying a protection net on the top portion of the transition support 3 to be extended to the pressure release area at the gob 29 for a certain distance such that the protection net can protect at the rib of the lower gateroad 22 if the pressure release area at the gob 29 is collapsed. In the premise of the transition support 3 satisfying for the above conditions, the main body structure of the transition support 3 can be selected from the conventional support structures used for mining coal, for example, a hydraulic column support or the like such as a support of combining the hinged leg with the hydraulic column. The forms of the supports are not limited thereto.

According to one embodiment of the present disclosure, optionally, at least one cutting device is mounted on the transition support 3. A longitudinal cutting work can be performed on the top rock mass by using the cutting device along a boundary line between the lower gateroad 22 (entry retaining area) and the pressure release area at the gob 29, in order to form the lower gateroad 22 (entry retaining area). There is an advantage that the cutting device can be carried by the transition support 3, wherein, the cutting device may include a plurality of cutting drilling machines 8 (FIG. 5) by which a plurality of drilling holes is formed on the top rock mass at a certain distance, and then can be expanded to be linear slit by means of a blasting or expanding device. Herein, the cutting device is mounted on the transition support 3, and a working slot can be reserved on the top beam of the transition support 3, such that the cutting work can be performed from bottom to top.

According to one embodiment of the present disclosure, the end support 4 is positioned within the overlapped area between the mining passage 27 and the entry retaining area. The end support 4 may include two or three supports in parallel, and are positioned on the inner end of the mining passage 27 and the inner end of the lower gateroad 22. The lower gateroad 22 is formed by retaining entry after the gob area encounters the top-cutting pressure release, as a result, after the coal mining machine completes mining coal, the inner rib and the top portion of the lower gateroad 22 need to be strengthened. The rear portion of the end support 4 is positioned in the lower gateroad 22, the front portion of the end support 4 is positioned in the overlapped area with the mining passage 27, and the sides of the end support 4 may closely attach to the inner rib of the lower gateroad 22 and certainly may reserve a certain space, and thereby retaining gob-side in the front of the end support 4, in order to reserve a space through which the coal mining machine is operated. The end support 4 is disposed herein to support the mining passage 27 and the lower gateroad 22 simultaneously, may reserve sufficient space through which the coal mining machine passes and thereby cannot affect the mining work, and facilitate for arranging an anchor rod or an anchor line drilling machine by using the end support 4 in order to strengthen the inner rib and top portion of the lower gateroad 22 by means of the anchor line and/or the anchor rod. A protection net is overlaid on the top portion and is fixed by the anchor rod or the anchor line to prevent cracked rock from falling down and also facilitate for subsequent shotcrete reinforcement operation. In the premise of the end support 4 satisfying for the above conditions, the main body structure of the end support 4 can be selected from the conventional support structures used for mining coal, for example, a hydraulic column support or the like such as a support of combining the hinged leg with the hydraulic column. The forms of the supports are not limited thereto.

According to one embodiment of the present disclosure, due to installation of a multiple anchor line drilling machine on the end support 4, working holes and/or working slots 41 (FIG. 5) may be reserved on the top beam of the end support 4, in order to drill anchor holes from the bottom to the top and install the anchor lines or the anchor holes. The multiple anchor line drilling machine also has lateral anchor hole drilling machine in order to drill holes on the inner rib to install the anchor lines or the anchor rods.

According to one embodiment of the present disclosure, as shown in FIG. 3 and FIG. 4, there are multiple sets of the following supports 5 with at least two in each set. The multiple sets of the following supports 5 are positioned in the entry retaining area, and arranged in turn along the entry retaining area. The following supports 5 may continuously step and move forward as the coal mining system 7, and meanwhile realize the functions, such as gangue prevention, rib protection and support of the entry retaining area. Optionally, the first two or three sets of the following supports 5 can be selected as the top-cutting following supports 51, and the last two or three sets of the following supports 5 can be selected as the gauge prevention following support 52. The top-cutting following support 51 can be provided with a cutting drilling machine to match with the cutting device in the transition support, to ensure the integrate system to possess considerable top-cutting resistance force so as to ensure that the roof can smoothly collapse along the cutting face. The roof in the gob area under combined action of mine pressure and top-cutting resistance force can keep essentially and completely stable caving. A plurality of gangue prevention plates 54 (FIG. 4) may further be mounted between the entry retaining area of the lower gateroad 22 and the pressure release area at the gob 29, and laid on the outside rib of the entry retaining area. The gangue prevention plates are opened with a plurality of reserved holes, by use of which the anchor rods or the anchor lines are mounted to the pressure release area at the gob 29. The following support 5 is provided with a lateral support telescopic rod 53 (FIG. 4) for supporting the gangue prevention plate 54. The gangue prevention following support 52 can be equipped with the anchor rod drilling machine to construct grouting anchor rod to the entry rib of the gob area via the reserved holes at the gangue prevention plate.

The following support system according to the embodiment of the present disclosure can achieve the functions, such as top cutting, gangue prevention, grouting bolts construction and grouting at the rear position of the working face, which is favorable for smooth caving of the roof in the gob area, and strength and stability of the entry rib of the gob area can be further improved by means of grouting, and thereby a better effect of forming entry can be realized.

A plurality of retracting supports 6 may be arranged side by side to support the mining passage 27. A common support can also be selected as the retracting support 6, only reserving a space through which the coal mining system 7 passes in the front end thereof. Optionally, the anchor hole drilling machine, the net overlaying device 9 (FIG. 5) and the cutting device are mounted on the retracting support 6 in order to perform installation of the anchor rods or the anchor lines after overlaying net at a certain distance from the destination of the coal mining work, and finally roof caving is carried out by cutting work.

According to one implementation, the working face for mining coal can employ a special retracting support 6 with property of dust-proof and anti-collision rapid, guard plates at the top and the rear side are enlarged to form an enclosed plate, the gap between two adjacent retracting supports is sealed by means of flexible and friction resistance materials, and the top beam is designed with a cutting drill holes and anchor line drilling reserved holes. A plurality of retracting supports 6 may be closely attached side by side and arranged in the mining passage 27. The plurality of retracting supports 6 may face the sides of the pressure release area at the gob 29, and gap of the top surface thereof may be sealed with friction resistance materials. The plurality of retracting supports 6 are arranged till to engage with seal plate at the sides of the transition support 3. In this way, the gap between the mining passage 27 and the pressure release area a the gob 29 can be sealed by the retracting support 6 to avoid the dust from falling into the coal mining area and a ventilation passage when the pressure release area at the gob 29 is caved. Of course, it is also possible to add a layer of dust-proof net onto this boundary face, in order to protect individual seam again, and the dust-proof net can be moved forward along with movement of each support, and thereby being reused. In addition, a net overlaying device may be provided. The net overlying device may include a plurality of net rolls and axle groups. These net rolls may be arranged on the front ends or the rear ends of the transition support 3, the end support 4 or the first set of following supports 5. The protection net in the front of the transition support 3 is laid along the bottom of the top rock mass, and arranged between the transition support 3, the end support 4 and the top surface of the following support 5 and the bottom face of the top rock mass.

The coal mining system 7 includes a coal mining machine 71 and a scraper conveyor 72. The scraper conveyor 72 is position on the bottom of the mining passage 27. The coal mining machine is movably mounted on the scraper conveyor 72. A coal conveying belt 73 may be equipped in the upper gateroad 21 in order to match with the scraper conveyor 72 to convey the mined coal out.

According to the embodiment of the present disclosure, referring to FIG. 2 to FIG. 5, during working, as the coal mining system 7 advances mining, the mining passage 27 is advanced forward, and the transition support 3, the end support 4, the following support 5 and the retracting support 6 move forward along with the mining passage 27. A longitudinal cutting work can be performed on the top rock mass by using the cutting device along a boundary line between the entry retaining area and the pressure release area at the gob 29. The top rock mass in the gob area is continuously caved to form the pressure release area at the gob 29. Due to bulking characteristics of the rock, a stable support of the geological structure of the pressure release area at the gob 29 can be finally achieved.

During mining, continuous cutting work on the roof is used to cause the pressure release area at the gob 29 to be continuously collapsed to form a stable support for the pressure release area at the gob 29, while the following support 5 and pre-set anchor rod or anchor line are used to retain an entry on the position near to the next working face 20, such that the lower gateroad 22 is formed. As for the entry retaining area according to this embodiment, the pressure of the upper roof is released by cutting from the outside so that the upper roof of the entry retaining area actually is a stable cantilever beam structure. In addition, the mining face 23 has the mining passage 27. In this embodiment, the upper gateroad 21, the mining passage 27, the lower gateroad 22 and the haulage dip 28 are communicated in turn, that is, the passages of the ventilation system are always in communication.

In this embodiment, the mining process of each working face 20 includes following steps:

excavating the haulage dip 28 around the district 2;

mining in a direction from one end away from the air-return dip 25 and the track dip 26 (i.e., one end close to the haulage dip 28) toward the air-return dip 25 and the track dip 26;

forming the pressure release area at the gob 29 during mining, wherein a coal mining machine may be used to cut a neat coal wall at the end of a district; the coal wall is used as one entry rib of the gateroad, and the other rib is formed by means of continuously top-cutting; the entry rib is automatically formed after roof caving, thus forming a gateroad in a re-mining process; the coal mining machine is under digital control when its end cuts the coal, automatically enabling the end to laterally cut the coal wall to form a vertical straight line, which is used as the entry rib of the gateroad; and the scrapper conveyor works in coordination with an arc-shaped coal grabbing plate of the coal mining machine to clean up float coal at the end as much as possible.

Pressure is released by the roof-cutting and the entry is retained during the mining process, the retained entry position is a side portion 22 close to the next working face 20. The transition support 3 is equipped with a cutting drilling machine, a fracturing machine and a top net conveying system in the front of the support. The support has a fixing plate of 3 m-5 m on the rear part thereof. Construction of cutting and drilling holes are applied to the roof by means of the cutting drilling machine, after construction of cutting and drilling holes, cracks are formed on the roof by tension of the fracturing machine. After the coal seam is mined, the roof of the pressure release area at the gob 29 is automatically cut down along the cracks to form the entry rib. The fixing plate can be used as the temporary gangue prevention. The end is equipped with two to three end supports 4 together, and can be equipped with anchor rod (line) drilling machine and net overlaying system behind the support, after overlaying the net on the roof via the net overlaying system behind the support, the anchor drilling holes are applied to the roof by means of the anchor rod drilling machine, after accomplishment of drilling holes, the anchor lines are installed to support the roof.

In this embodiment, the air-return dip 25 and the track dip 26 are unchanged throughout the mining process in order to fix the passages. The haulage dip 28 can be gradually changed along the retained entry during mining in order to adapt for variation of the passages. And the haulage dip 28, after the district 2 is mined out, forms a passage that is substantially parallel to the air-return dip 25 and the track dip 26.

The following support 5 closely follows the fixing plate on the rear part of the transition support 3 to build the gangue prevention plate to support the gangues of the pressure release area at the gob 29. The gangue prevention plates are connected with each other to form a whole, and can be removed for reuse after accomplishment of grouting.

The above-mentioned working face equipment system is a novel equipment system for the mining method, by which the no-entry excavation non-pillar mining can be achieve, and lays a solid foundation for implementation of the longwall mining method.

It can be seen from the above technical solutions that the equipment system for the no-entry non-pillar entry self-retaining mining method of the present disclosure has advantages and positive effects:

When a general working face mining is performed, the retained entry on the side of the previous working face is taken as the upper gateroad, the mining passage in the mining face is taken as a ventilation passage, and the self-retained entry is taken as the lower gateroad, a complete ventilation system is still formed. In this process, there is no need to separately excavate the upper gateroad and the lower gateroad in any working face before mining work, only retaining entry during mining instead, thereby, work efficiency can be improved and resource consumption can be reduced.

As above described, numerous specific details are presented to provide more thorough understanding of the present disclosure. However, it would be obvious to the person skilled in the art that the present disclosure may be practiced without one or more of the specific details. As the other examples, some technical features well known in the art are not described in order to avoid any confusion with the present disclosure.

The terms "a", "an" and "the" are directed to express the presence of one or more elements when the elements of the present disclosure or the preferable embodiments of the present disclosure are described. The terms "comprise", "contain" and "have" and the like are intended to be inclusive and mean there may be additional elements other than the listed elements.

What is claimed is:

1. An equipment system for entry self-retaining mining method, wherein, the equipment system comprises a transition support, an end support, a following support, a retracting support, a cutting device and a coal mining system; the coal mining system is located in a mining passage and has an outer end connected to an upper gateroad and an inner end connected to a lower gateroad; the lower gateroad is an entry retaining area, the upper gateroad and the lower gateroad are substantially parallel to a mining direction of the coal mining system, and an area between the rear side of the mining passage and the outer side of the entry retaining area is a pressure release area at a gob;

the transition support, the end support, the following support and the retracting support telescopically support a bottom rock mass and a top rock mass of the district; the transition support is positioned between the mining passage, the pressure release area at the gob and the entry retaining area; the end support is positioned within an overlapped area between the mining passage and the entry retaining area; there are multiple sets of the following supports with at least two in each set, and the following supports are positioned in and arranged in turn along the entry retaining area; the retracting support supports the mining passage;

working slots are reserved in a top beam of the transition support, working holes or slots are reserved on a top beam of the end support.

2. The equipment system for entry self-retaining mining method according to claim 1, wherein, the cutting device comprises at least one cutting drilling machine by which a plurality of drilling holes are formed on the top rock mass at a certain distance, and the plurality of drilling holes are expanded to be linear slits by a blasting or expanding device.

3. The equipment system for entry self-retaining mining method according to claim 1, wherein, a plurality of common supports are further arranged in the mining passage and telescopically support the bottom rock mass and the top rock mass.

4. The equipment system for entry self-retaining mining method according to claim 1, wherein, the equipment system further has a net overlaying device, and a protection net is laid in the front of the transition support and the end support along the bottom of the top rock mass, and the protection net is arranged between the transition support, the end support and the top surface of the following support and the bottom surface of the top rock mass.

5. The equipment system for entry self-retaining mining method according to claim 1, wherein, the coal mining system comprises a coal mining machine and a scraper conveyor, and the scraper conveyor is positioned on the bottom of the mining passage, and the coal mining machine is movably mounted on the scraper conveyor.

6. The equipment system for entry self-retaining mining method according to claim 1, wherein, wherein a plurality of gangue prevention plates are mounted between the entry retaining area and the pressure release area at the gob, and are laid on an outside rib of the entry retaining area; the gangue prevention plates are provided with a plurality of reserved holes through which anchor rods or anchor lines are mounted onto the gob pressure-relied area.

7. The equipment system for entry self-retaining mining method according to claim 6, wherein, the following supports are provided with lateral support telescopic rods that support the gangue prevention plates.

8. The equipment system for entry self-retaining mining method according to claim 7, wherein, the equipment system further comprises a plurality of anchor hole drilling machines, by means of which the anchor lines or the anchor rods are mounted on the top or the rib of the entry retaining area.

9. The equipment system for entry self-retaining mining method according to claim 1, wherein, the transition support is provided with the cutting device.

10. The equipment system for entry self-retaining mining method according to claim 1, wherein, at least one anchor line drilling machine is mounted on the end support.

* * * * *